US006398517B1

(12) United States Patent
Choi

(10) Patent No.: US 6,398,517 B1
(45) Date of Patent: Jun. 4, 2002

(54) TURBO COMPRESSOR

(75) Inventor: Jun-won Choi, Kyongsangnam-do (KR)

(73) Assignee: Samsung Techwin Co., Ltd., Kyongsangnam-do (KR)

( * ) Notice: Subject to any disclaimer, the term of this patent is extended or adjusted under 35 U.S.C. 154(b) by 0 days.

(21) Appl. No.: 09/617,513

(22) Filed: Jul. 14, 2000

(30) Foreign Application Priority Data

Jul. 15, 1999 (KR) ..... 99-28687

(51) Int. Cl.[7] ..... F04B 23/00
(52) U.S. Cl. ..... 417/243; 417/423.5; 417/423.12
(58) Field of Search ..... 417/243, 423.5, 417/423.12

(56) References Cited

U.S. PATENT DOCUMENTS 4,105,372 A * 8/1978 Mishina et al. ..... 417/243
4,362,462 A * 12/1982 Blotenberg ..... 417/243 X
4,685,509 A * 8/1987 Koeller ..... 417/243 X
5,110,264 A * 5/1992 Murry ..... 417/243 X
5,450,719 A * 9/1995 Marsh ..... 60/39.75
5,980,218 A * 11/1999 Takahashi et al. ..... 417/243

* cited by examiner

*Primary Examiner*—Hoang Nguyen
(74) *Attorney, Agent, or Firm*—Finnegan, Henderson Farabow, Garrett & Dunner LLP

(57) ABSTRACT

A turbo compressor includes a motor having a rotation shaft rotatable at a high speed, a first impeller installed at one end portion of the rotation shaft for primarily compressing outside air, and a first volute housing for containing the air compressed by the first impeller. The compressor also includes an intercooler having an inlet portion and an outlet portion, the inlet portion being installed adjacent the first volute housing for cooling the air compressed by the first impeller, a second impeller installed at the other end portion of the rotation shaft for secondarily compressing the air flowing from the intercooler, and a second volute housing for containing the air compressed by the second impeller. The compressor further includes a duct connecting the outlet portion of the intercooler to an inlet portion of the second impeller.

5 Claims, 3 Drawing Sheets

TURBO COMPRESSOR

BACKGROUND OF THE INVENTION

1. Field of the Invention

The present invention relates to a turbo compressor, and more particularly, to a turbo compressor for compressing air by using an impeller driven by a high speed motor.

2. Description of the Related Art

In general, there are several types of compressors, for example, piston compressors, rotor compressors and turbo compressors. In a turbo compressor, air is compressed by an impeller connected to a rotation shaft of a motor which rotates at a high speed. The turbo compressor may pose a stability problem because it has a complicated driving mechanism for the impeller and the bearings supporting the impeller are exposed to the conditions of high speed, heavy parts, and heat. For example, a typical turbo compressor uses a gear system to transfer power to the impeller.

FIG. 1 is a schematic view showing the structure of a conventional turbo compressor. Referring to the drawing, the turbo compressor includes a low-speed motor (not shown) for supplying power for rotation, a gear system 8 installed to convert the low speed rotational power to a high speed rotational power, a first impeller 1 provided for compressing air in the first phase, a first volute housing 2 for containing the air compressed by the first impeller 1, a second impeller 3 for compressing the air in a second phase, a second volute housing 4 for containing the air compressed by the second impeller 3, a bearing 5 for supporting a rotation shaft shared by the first and second impellers 1 and 3, respectively, a third impeller 6 for compressing the air in the third phase, and a third volute housing 7 for containing the air compressed by the third impeller 6. A cooling apparatus (not shown) for cooling the air compressed by the respective impellers may be installed to cool the compressed air at each step.

The conventional turbo compressor typically uses the gear system 8 as described above. The gears of gear system 8 commonly pose several problems and disadvantages, such as, since gears are heavy and voluminous, they require huge installation space should and increase the total weight of the compressor. In addition, the continuous motion of various parts of the gears generate low frequency vibrations and undesirable noise. Furthermore, the gear system requires periodic maintenance, including lubricating and controlling temperature of the various parts of the gear system, including a tilting pad bearing or ball bearing for supporting the rotation shaft. Therefore, a complicated system is necessary for providing an appropriate lubricating system and control of temperature. In particular, the turbo compressor needs a complicated sealing system for preventing intrusion of lubricant into the impeller.

When a motor for driving an impeller in a conventional turbo compressor is driven by electric power, the motor requires a starting current that is three or four times higher than regular current. Thus, the compressor needs a larger power equipment for the driving motor, which increases cost and requires bigger installation space. Also, since the maximum capacity of the driving motor is obtained at a particular frequency of the power, for example, 50 or 60 Hz, the whole system must be designed according to the frequency of the power.

Therefore, there is a need for a turbo compressor which has a simplified system and improved efficiency.

SUMMARY OF THE INVENTION

The advantages and purposes of the invention will be set forth in part in the description which follows, and in part will be obvious from the description, or may be learned by practice of the invention. The advantages and purposes of the invention will be realized and attained by the elements and combinations particularly pointed out in the appended claims.

To attain the advantages and consistent with the principles of the invention, as embodied and broadly described herein, one aspect of the invention is a turbo compressor, comprising a motor having a rotation shaft rotatable at a high speed, a first impeller installed at one and portion of the rotation shaft for primarily compressing outside air, and a first volute housing for containing the air compressed by the first impeller. The compressor also comprises an intercooler having an inlet portion and an outlet portion, the inlet portion being installed adjacent the first volute housing for cooling the air compressed by the first impeller, a second impeller installed at the other and portion of the rotation shaft for secondarily compressing the air flowing from the intercooler, and a second volute housing for containing the air compressed by the second impeller. The compressor further includes a duct connecting the outlet portion of the intercooler to an inlet portion of the second impeller.

Consistent with the principles of the present invention, other aspects of the invention include the following. The rotation shaft of the motor may be supported by at least one air foil bearing. The motor may be controlled by an inverter module. The air supplied to the air foil hearings is supplied from the second volute housing. The air supplied to the air foil bearings is supplied by an external pressing apparatus. The air foil bearings comprise a housing, and a plurality of air foils installed at an inner surface of the housing for supporting the rotation shaft of the motor with a fluid film of the compressed air.

Further consistent with the principles of the present invention, the air foil bearings have a structure utilizing a flexible multi-leaf type foil which characteristically provides a large amount of play to misalignment inside a large motor. Since multiple shoots of foils are overlapped, the multi-leaf type foil bearing exhibits strong resistance against vibrations or impacts. Further, when coating of a surface of the foil is damaged, the effect on performance of the bearing can be reduced.

It is to be understood that both the foregoing general description and the following detailed description are exemplary and explanatory only and are not restrictive of the invention as claimed. Additional advantages will be set forth in the description which follows, and in part will be understood from the description, or may be learned by practice of the invention. The advantages and purposes may be obtained by means of the combinations set forth in the attached claims.

BRIEF DESCRIPTION OF THE DRAWINGS

The accompanying drawings, which are not incorporated in and constitute a part of this specification, illustrate an embodiment of the invention and, together with the description, serve to explain the principles of the invention. In the drawings in which.

DETAILED DESCRIPTION OF THE INVENTION

Reference will now be made in detail to an embodiment of the apparatus consistent with the principles of the present invention, examples of invention, examples of which are illustrated in the accompanying drawings. The invention will be further clarified by the following examples which are intended to be exemplary of the invention.

Figure 1:
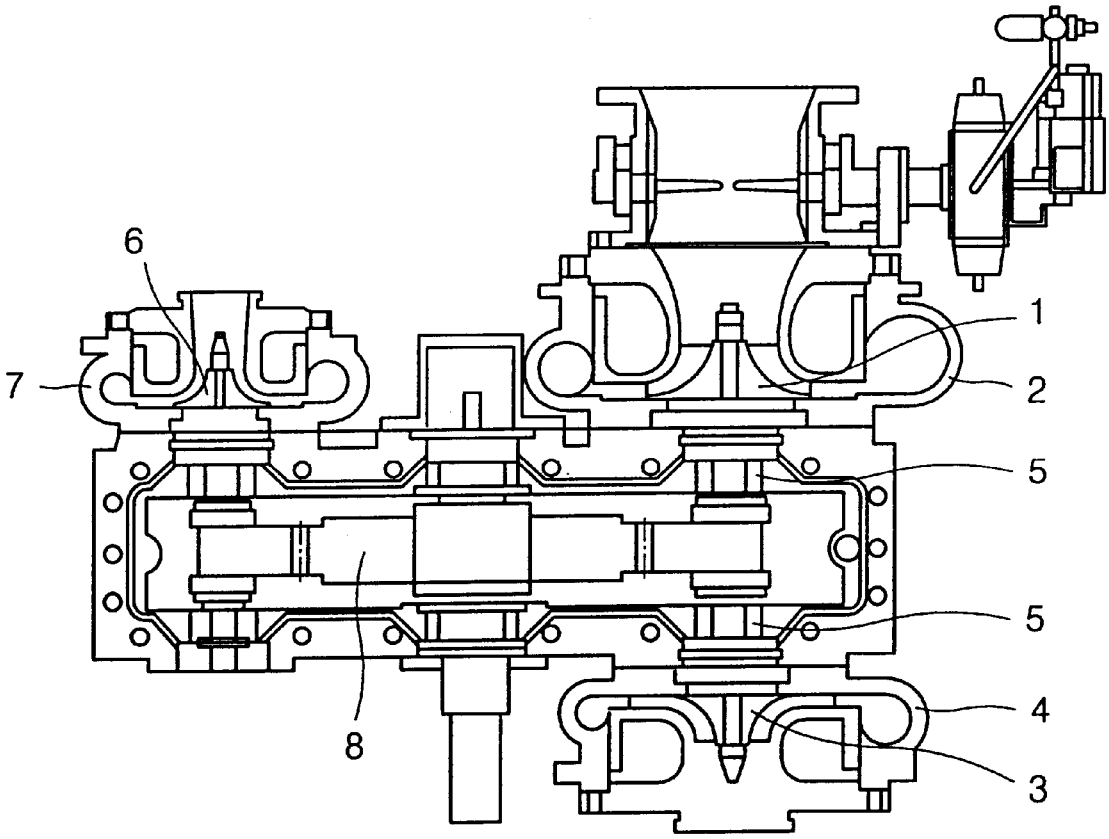
FIG. 1 is a view showing the structure of the conventional turbo compressor.
Figure 2:
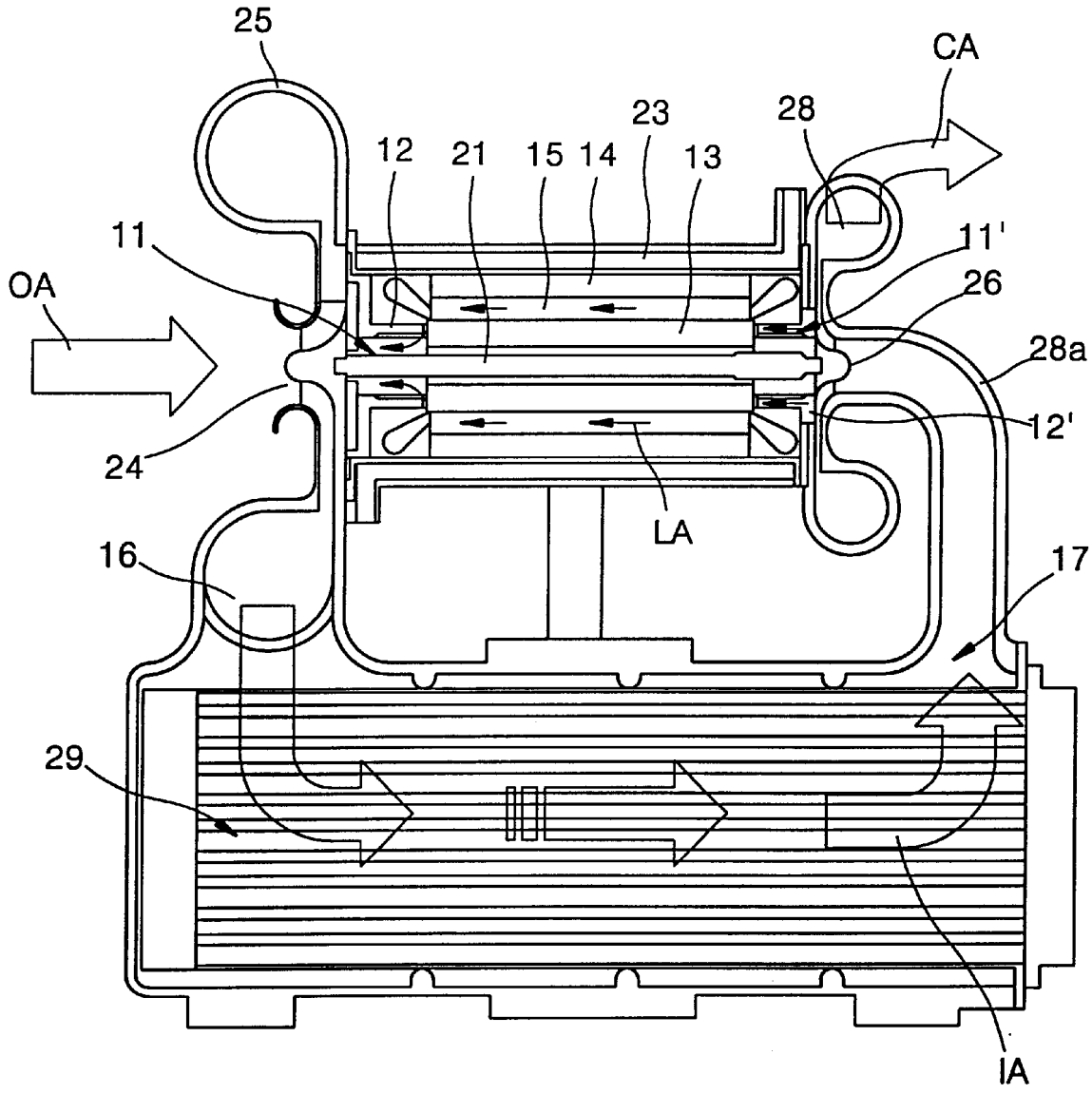
FIG. 2 is a view showing the structure of a turbo compressor consistent with the principles of the present invention.

Referring to FIG. 2, consistent with the principles of the present invention, a high speed motor is used as an impeller driving means in a turbo compressor, and an impeller is directly connected to a rotation shaft of the motor to compress air. For example, a high speed motor 23 rotating over 70,000 r.p.m. may be used. The motor 23 is provided with a rotation shaft 21. A first impeller 24 and second impeller 26 are installed at either end portion of the rotation shaft 21. A rotor 13 of the motor 23 is installed around the outer circumference of the rotation shaft 21 and a state 14 is installed inside a housing (not shown) of the motor 23.

A plurality of vanes (not shown) are installed at the first impeller 24 and the first impeller 24 primarily compresses air while rotating. Outside air indicated by an arrow OA is compressed by the first impeller 24. The compressed air is contained in the first volute housing 25 and exhausted to an intercooler 29. As shown in the drawing, an inlet portion 16 for passing the air to the intercooler 29 is formed close to the first volute housing 25. A typical intercooler may be used as the intercooler 29 for cooling the temperature of the air raised due to compression. The temperature of the primarily compressed air can be lowered to about 40° C.

A plurality of vanes (not shown) are installed at the second impeller 26. The second impeller 26 secondarily compresses air while rotating. The air which has been cooled by the intercooler 29 is input to the second impeller 26, which is indicated by an arrow IA. The cooled air IA passes through a duct 28*a* connecting an outlet portion 17 of the intercooler 29 and an inlet portion (not shown) on the second impeller 26 and is input to the second impeller 26. The air compressed by the second impeller 26 to a final pressure is contained in a second volute housing 28 and then exhausted for a predetermined use. An arrow CA denotes the finally compressed air.

Further consistent with the principles of the present invention, the rotation shaft 21 of the high speed motor 23 is supported by an air foil bearing. In FIG. 2, a first end portion of the rotation shaft 21 where the first impeller 24 is installed is supported by a first air foil bearing 11 and a second end portion of the rotation shaft 21 where the second impeller 26 is installed is supported by a second air foil bearing 11', so that the rotation shaft 21 can rotate between the first and second air foil bearings 11 and 11', respectively. As well known to a person skilled in the art, the first and second air foil bearings 11 and 11' include housings 12 and 12', respectively, through which the end portions of the rotation shaft 21 pass and a plurality of air foils (not shown) installed at the inner circumferential surface of the housings 12 and 12', respectively. When the compressed air is allowed to pass between the foil and the end portion of the rotation shaft 21 on surfaces of the air foils, by the high speed rotation of the rotor 13, a fluid film is formed by the air so that the end portions of the rotation shaft 21 are rotatably supported without friction.

The compressed air can be supplied to the air foil bearings 11 and 11' in various manners. In the embodiment shown in the drawing, the compressed air for lubricating is supplied from the second volute housing 28. That is, the compressed air is supplied from the second volute housing 28 via an air flow path (not shown) to the second air foil bearing 11'. Then, the compressed air is supplied to the first air foil bearing 11 via an air flow path 15 formed between the stator 14 and the rotor 13. An arrow LA donates the flow of the compressed air flowing from the second air foil bearing 11' to the first air foil bearing 11.

In another embodiment (not shown), the compressed air can be supplied to the air foil bearings 11 and 11' by an additional external apparatus, not the second volute housing 28.

Figure 3:
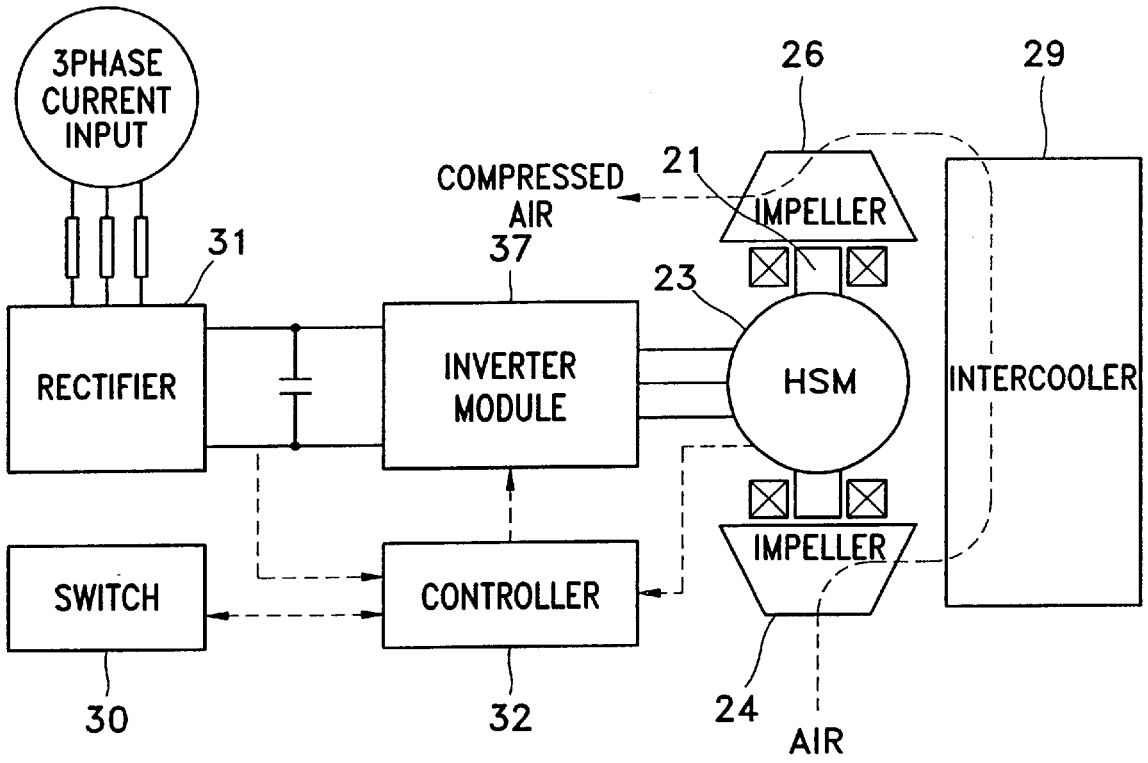
FIG. 3 is a block diagram schematically showing operation of the turbo compressor consistent with the principles of the present invention.

The operation of the turbo compressor having the above structure consistent with the principles of the present invention will be described with reference to FIG. 3. First, current applied by a three phase current input is rectified by a rectifier 31. The rectified current is applied to the high speed motor 23 through an inverter module 37. The inverter module 37 is controlled by a controller 32. The controller 32 can control the number of rotations of the motor 23 through the inverter module 37. A current value applied to the inverter module 37 from the rectifier 31 and a current value applied to the motor 23 are fed back to the controller 32 so that they are used as data when the controller 32 controls the inverter module 37. The controller 32 can cut off power by turning off a switch 30.

When the high speed motor 23 is driven by the current applied from the inverter module 37, the outside air OA of FIG. 2 input to the first impeller 24 is compressed by the first impeller 24 and cooled by the inter cooler 29, and further compressed by the second impeller 26 to a final target pressure. Here, the air foil bearings 11 and 11' support the rotation shaft 21 of the motor 23.

The inverter module 37 controls the number of rotations of the motor 23 so that the output of the motor 23 can be controlled. Also, by altering the rotation speed of the motor 23 by the inverter module 37, the operation of the first and second impellers 24 and 26, respectively, at varying speed is made easy so that the amount of exhausted air can be appropriately controlled. That is, the overall control system is made possible by the inverter module 37.

The driving method of the motor 23 by the inverter module 37 restricts start current when starting the motor 23, which reduces the size and cost of the power equipment. Also, since the gear system applied to the conventional turbo compressor is not needed, problems or disadvantages due to weight, vibrations and noise are reduced.

Also, by using the inverter module 37, the problem of design change according to a frequency is solved. Furthermore, an optimal operation speed is selected so that power needed to operate the system is reduced and an automated scope is expanded, thus improving overall reliability.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims and their equivalents.

I claim:

1. A turbo compressor comprising:

a motor having a rotation shaft rotatable at a high speed;

a first impeller installed at one end portion of the rotation shaft for primarily compressing outside air;

a first volute housing for containing the air compressed by the first impeller;

an intercooler having an inlet portion and an outlet portion, the inlet portion being installed adjacent the first volute housing for cooling the air compressed by the first impeller;

a second impeller installed at the other end of the rotation shaft for secondarily compressing the air flowing from the intercooler;

a second volute housing for containing the air compressed by the second impeller, wherein the rotation shaft of the motor is supported by at least one air foil bearing;

a duct connecting the outlet portion of the intercooler to an inlet portion of the second impeller; and an inverter module to control the motor.

2. The turbo compressor as claimed in claim 1, wherein the at least one air foil bearing for supporting the rotation shaft of the motor is a multi-leaf foil bearing.

3. The turbo compressor as claimed in claim 1, wherein the air supplied to the at least one air foil bearing is supplied from the second volute housing.

4. The turbo compressor as claimed in claim 1, wherein the air supplied to the at least one air foil bearing is supplied by an external pressing apparatus.

5. The turbo compressor as claimed in claim 1, wherein each of the at least one air foil bearing comprises:

a housing; and a plurality of air foils installed at an inner surface of the housing, for supporting the rotation shaft of the motor with a fluid film of the compressed air.

* * * * *